US007529491B2

(12) United States Patent
Rommelmann et al.

(10) Patent No.: US 7,529,491 B2
(45) Date of Patent: May 5, 2009

(54) APPARATUS AND METHOD FOR ADAPTING A MACHINE TO COMMUNICATE WITH CUSTOMER REPLACEABLE UNIT MONITORS HAVING DIFFERENT INTERFACE FORMATS

(75) Inventors: Heiko Rommelmann, Penfield, NY (US); Jerry Money, Rochester, NY (US); Scott J. Bell, Rochester, NY (US); Alberto Rodriguez, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 307 days.

(21) Appl. No.: 11/227,042

(22) Filed: Sep. 15, 2005

(65) Prior Publication Data

US 2007/0058991 A1 Mar. 15, 2007

(51) Int. Cl.
*G03G 15/00* (2006.01)
*H01R 13/02* (2006.01)
*H01R 13/627* (2006.01)

(52) U.S. Cl. ..... 399/12; 399/24; 439/225; 439/361

(58) Field of Classification Search ..... 399/12, 399/24–27; 439/630, 225, 638, 361
See application file for complete search history.

(56) References Cited

U.S. PATENT DOCUMENTS 5,077,582 A 12/1991 Krevette et al.
5,305,199 A 4/1994 LoBiondo et al.
6,016,409 A 1/2000 Beard et al.
6,023,593 A 2/2000 Tomidokoro
6,173,128 B1 1/2001 Saber et al.
6,529,692 B1 3/2003 Haines et al.
6,669,487 B1 * 12/2003 Nishizawa et al. ..... 439/60
6,798,997 B1 9/2004 Hayward et al.
2002/0076224 A1 6/2002 Pollocks
2006/0014434 A1 * 1/2006 Yamamoto et al. ..... 439/630
2006/0023040 A1 * 2/2006 Castle et al. ..... 347/86

* cited by examiner

*Primary Examiner*—David M Gray
*Assistant Examiner*—Joseph S. Wong
(74) *Attorney, Agent, or Firm*—Wiggins and Dana LLP

(57) ABSTRACT

An adapter suitable for installation in a machine in place of a customer replaceable unit monitor having a first interface format is described herein. Upon installation of the adapter in the machine, the adapter enables data communication between the machine and a customer replaceable unit monitor having a second interface format that is different than the first interface format. The first and second interface formats may include one or more of: configuration of an electrical interface of the customer replaceable unit monitor, configuration of a mechanical interface of the customer replaceable unit monitor, and configuration of data input to and output from the customer replaceable unit monitor. The adapter may be attached to a module before the module is installed in the machine to simplify installation of the adapter. The adapter may remain attached to the machine when the module is removed from the machine to allow the machine to communicate with other customer replaceable unit monitors having the second interface format. The second customer replaceable unit monitor may include a microprocessor and non-volatile memory disposed in a common package.

31 Claims, 7 Drawing Sheets

APPARATUS AND METHOD FOR ADAPTING A MACHINE TO COMMUNICATE WITH CUSTOMER REPLACEABLE UNIT MONITORS HAVING DIFFERENT INTERFACE FORMATS

BACKGROUND

The present disclosure relates to replaceable modules, also known as "customer replaceable units" or CRUs, having electronically-readable memory devices, also known as "customer replaceable unit monitors" or CRUMs, attached thereto. More specifically, the present disclosure relates to a system and method for adapting machines to communicate with CRUMs having different interface formats.

A common trend in machine design is to organize a machine on a modular basis, wherein certain distinct subsystems of the machine are bundled together into modules which can be readily removed from the machine and replaced with new modules of the same or similar type. A modular design facilitates great flexibility in the business relationship with the customer. By providing subsystems in discrete modules, visits from a service representative can be made very short, since all the representative has to do is remove and replace a defective module. Actual repair of the module may take place remotely at the service provider's premises. Further, some customers may wish to have the ability to buy modules "off the shelf," such as from an equipment supply store. Indeed, it is possible that a customer may lease the machine and wish to buy a supply of modules as needed. Further, the use of modules, particularly for expendable supply units (e.g., copier and printer toner bottles) are conducive to recycling activities. In addition, modules may be used for anti-theft or security purposes, for example where the module may be removed by the user to disable the machine (e.g., face plates on automobile radios and wireless network cards installed in laptop computers).

In order to facilitate a variety of business arrangements among manufacturers, service providers, and customers, it is known to provide these modules with CRUMs, which, when the module is installed in the machine, enable the machine to both read information from the CRUM and also write information to the CRUM. The information read from, or written to, the CRUM may be used by the machine to perform various functions.

As CRUM technology has progressed, the capabilities of the CRUM (e.g., storage capacity, speed, power consumption, etc.) has improved, the size of the CRUM has decreased, and the cost of manufacturing the CRUM has decreased. New machines can be designed and built to accommodate the mechanical, electrical, and data interface format of these newer CRUMs. However, for machines designed to communicate with older CRUMs having a different interface format, incorporating this new and less expensive technology typically requires that a portion of the machine's hardware be replaced, which can be costly both in terms of designing and installing the new hardware.

BRIEF SUMMARY

According to one aspect, there is provided an adapter suitable for installation in a machine in place of a first customer replaceable unit monitor having a first interface format. Upon installation of the adapter in the machine, the adapter enables data communication between the machine and a second customer replaceable unit monitor having a second interface format that is different than the first interface format.

According to another aspect, there is provided a method for adapting a machine to communicate with different customer replaceable unit monitors. The method comprises: installing an adapter in a machine in place of a first customer replaceable unit monitor having a first interface format; installing a replaceable module into the machine, the replaceable module including a second customer replaceable unit monitor having a second interface format that is different than the first interface format; wherein the adapter enables data communication between the machine and the second customer replaceable unit monitor.

According to yet another aspect, there is provided a machine comprising a terminal attached to the machine. The terminal is configured to receive a first customer replaceable unit monitor having a first interface format. A replaceable module is installed in the machine, and a second customer replaceable unit monitor is attached to the replaceable module. The second customer replaceable unit monitor has a second interface format that is different than the first interface format. An adapter is coupled to the terminal in place of the first customer replaceable unit monitor. The adapter enables data communication between the machine and the second customer replaceable unit monitor.

BRIEF DESCRIPTION OF THE DRAWING

Referring now to the figures, which are exemplary embodiments, wherein like items are numbered alike.

DETAILED DESCRIPTION

Figure 1:
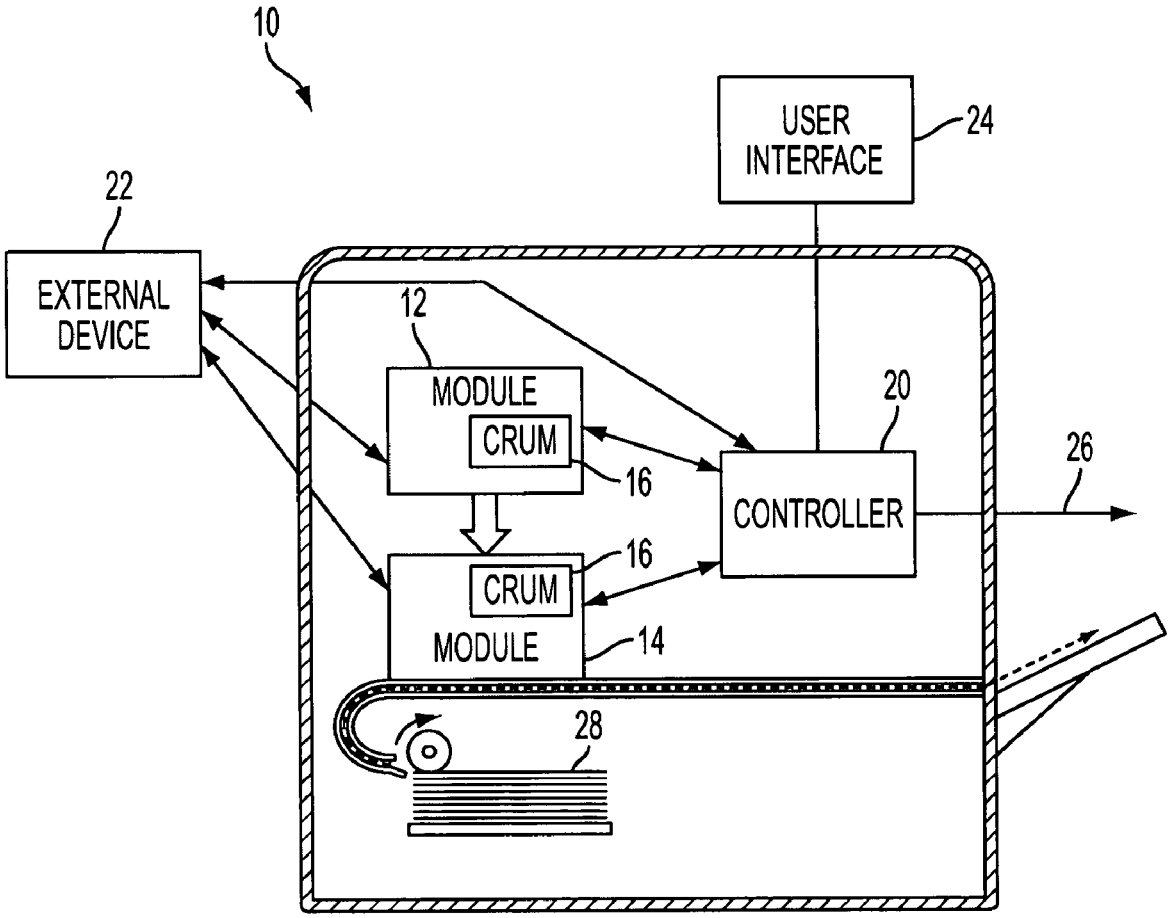
FIG. 1 is a schematic depiction of a machine including replaceable modules, each having a CRUM attached thereto.

FIG. 1 is a schematic depiction of a machine 10 including replaceable modules 12 and 14, also known as "customer replaceable units" or CRUs. Attached to each of the modules 12 and 14 is an electronically-readable memory device 16, also known as a CRUM (Customer Replaceable Unit Monitor). Typically, each CRUM 16 includes a non-volatile memory, such as in the form of an EEPROM (Electrically Erasable Programmable Read Only Memory), which retains data relevant to the identification, function, and performance of the associated module 12 or 14. Because it includes a non-volatile memory, the CRUM can act as a "scratch pad" for retaining the data stored therein, which travels with the replaceable modules 12 and 14, even when the modules 12 and 14 are not installed in the machine 10.

For purposes of discussion herein, the machine 10 is depicted as a printing apparatus, such as a digital printer of the ink jet or "laser" (electrophotographic or xerographic) variety, or a digital or analog copier. The modules 12 and 14 are depicted as hardware devices related to printing, such as a marking material supply module and a marking device module, respectively. It is contemplated, however, that the machine 10 may be any electrical, electronic, mechanical, electromechanical device configured to perform one or more functions, and the modules 12 and 14 may be any component, group of components, system, or subsystem of the machine 10.

In the embodiment of FIG. 1, the machine 10, includes a controller 20, which generally controls the operation of the machine 10. When the modules 12 and 14 are installed in the machine 10, the controller 20 communicates with the modules 12 and 14 via data paths, which are indicated by double-ended arrows in FIG. 1. In addition, data may be communicated between a device 22 external to the machine 10 and one or both of the CRUMs 12, 14 and the controller 20. Controller 20 may also communicate with users through a user interface 24 or through a network connection 26, such as over phone lines or the Internet.

In operation, sheets on which images are to be printed are drawn from a stack 28 and move relative to the marking device module 14, where the individual sheets are printed upon with desired images. The marking material for placing marks on various sheets by marking device module 14 is provided by marking material supply module 12. If machine 10 is an electrostatographic printer, marking material supply module 12 may include a supply of toner, while marking device module 14 includes any number of hardware items for the electrostatographic process, such as a photoreceptor or fusing device. In the well-known process of electrostatographic printing, the most common type of which is known as "xerography," a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finally divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate, such as paper from the stack 28, and the image affixed thereto to form a permanent record of the image.

In the ink-jet context, the marking material supply module 12 includes a quantity of liquid ink, and may include separate tanks for different primary-colored inks, while marking device module 14 includes a printhead. In either the electrostatographic or ink-jet context, "marking material" can include other consumed items used in printing but not precisely used for marking, such as oil or cleaning fluid used in a fusing device. Of course, depending on a particular design of a machine 10, the functions of modules 12 and 14 may be combined in a single module, or alternatively, the marking device may not be provided in an easily replaceable module such as 14. Further, there may be provided several different marking material supply modules 12, such as in a full color printer. In general, for purposes of the present embodiment, there may simply be provided one or more replaceable modules associated with the machine 10, and it is expected that, at times within the life of machine 10, one or more of these modules need to be removed or replaced. In the current market for office equipment, for example, it is typically desirable that modules such as 12 and 14 be readily replaceable by the end user, thus saving the expense of having a representative of the vendor visit the user.

There are many different types of data which could be stored in CRUM 16. In a broad sense, the CRUM could retain a serial number of the particular module, and identification of the module by the serial number can be used by the machine in which the module is installed to determine, for example, whether the particular installed module is compatible with the machine. In other types of CRUM systems, the CRUM can further act as an "odometer" to maintain a cumulative count indicating use of the module. For example, where the module is to be used with a printing apparatus, the count may indicate the number of prints which have been output using the particular module. In many contexts, a system will use the count in the CRUM to permit a certain predetermined number of times that the module may be used (e.g. a predetermined number of prints to be output with the particular module), and then block further use of the module. In more sophisticated versions of the odometer concept, there may be provided within a single CRUM provision for maintaining multiple usage counts: for instance, in addition to counting the number of times the module has been used (e.g., the number of prints output using the module) since it was built, a second count may be maintained of how many times the module was used since it was last remanufactured (refilled or repaired). In another example, a second count may serve as a check on the first count, such as in a system whereby the first count must be somehow mathematically consistent with the second count, so that any person trying to tamper with either the first or second count will have to know to make the second count consistent with the first count. Also, in particular with marking material supply modules, different independent print counts may be associated with the different supplies of color marking materials.

Another type of data which may be stored in a particular location in the non-volitile memory of the CRUM 16 may relate to specific performance data associated with the module, so that the module can be operated in an optimal, or at least advisable, manner. For instance, in the ink jet context, it is known to load data symbolic of optimal voltage or pulse width in the CRUM, so that the particular module may be optimally operated when the module is installed. In the xerographic context, it is known to load into a CRUM module specific data such as relating to the tested transfer efficiency of toner from a photoreceptor to a print sheet: this information is useful for an accurate calculation of toner consumption. Again, there may be provided any number of spaces in the CRUM memory for retaining information relating to different performance data.

Other types of data which may be included in the non-volatile memory in CRUM 16 include one or more serial numbers of machines, such as printers, in which the particular module is or has been installed: this may be useful for tracing faults in the module or among a population of machines. Also, if the particular module is intended to be remanufactured, another useful piece of data to be loaded into the memory can be the date of the last remanufacture of the module, as well as a code relating to some detail of the remanufacture, which may be symbolic of, for instance, a location of the remanufacture, or the specific actions that were taken on the module in a remanufacturing process.

Figure 2:
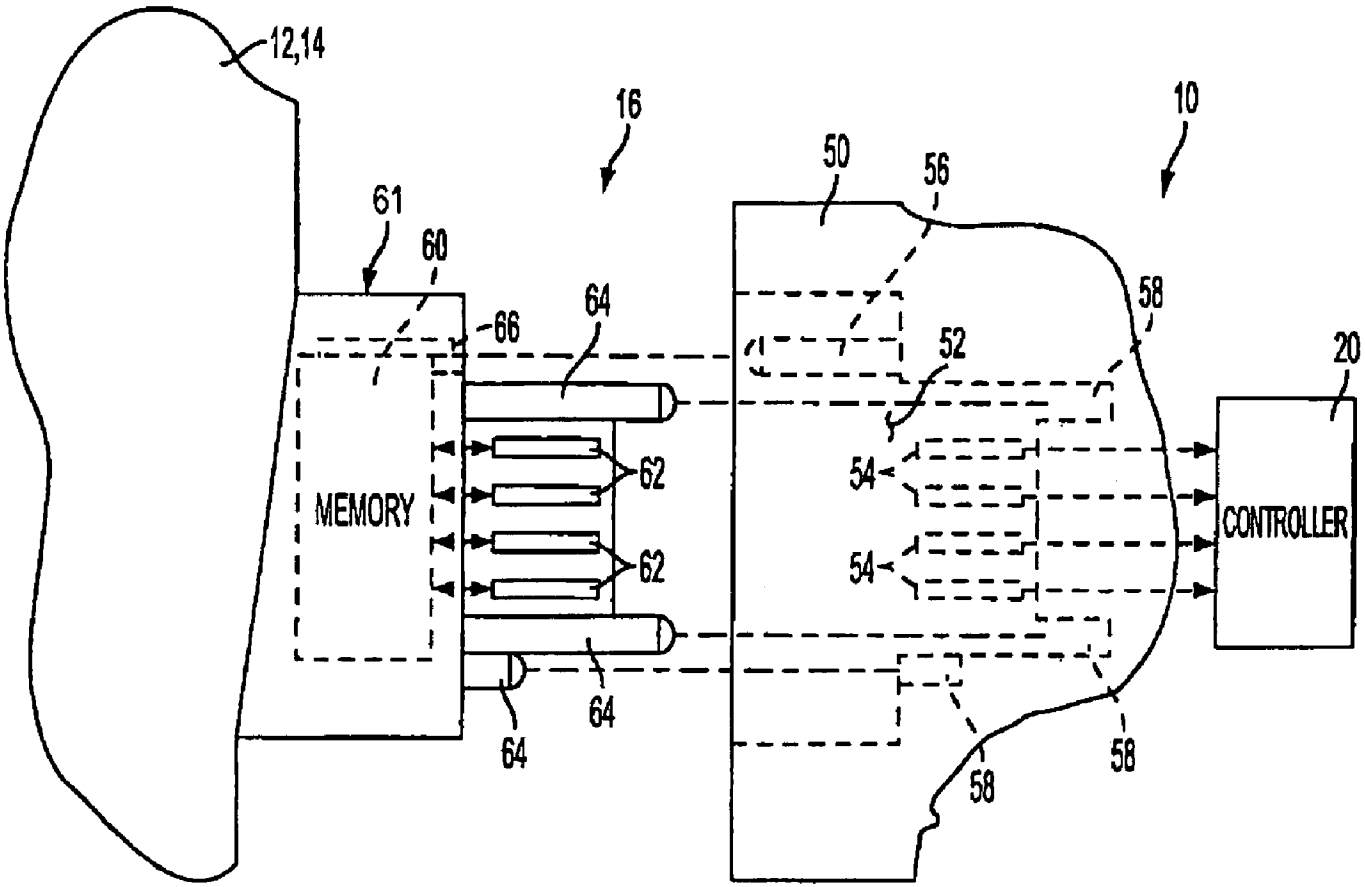
FIG. 2 is a partially-exploded, plan view of the interconnection between a first CRUM and the machine.
Figure 3:
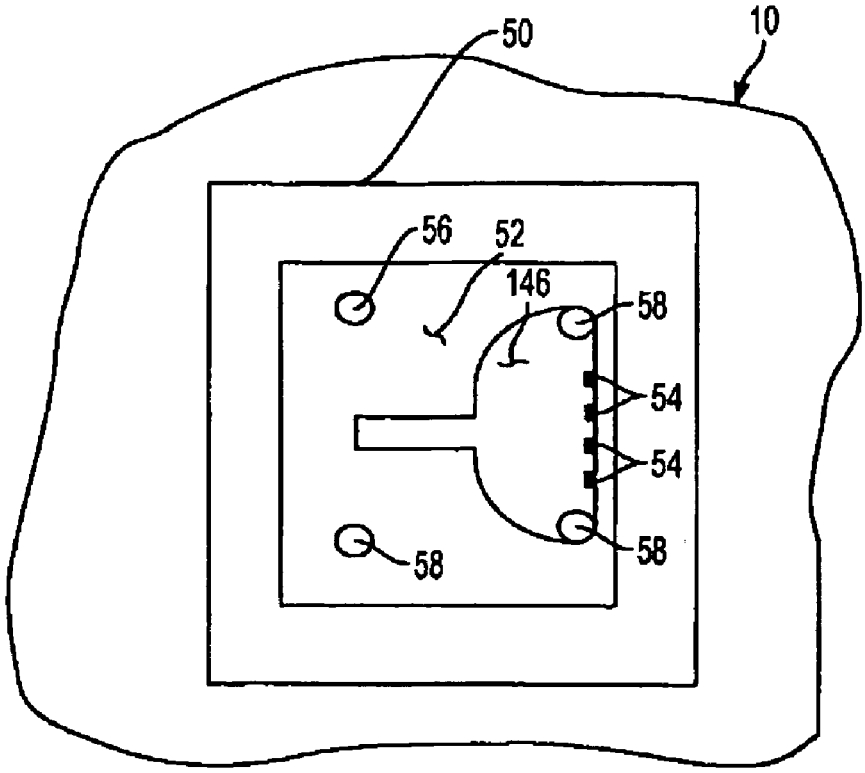
FIG. 3 is a plan view of a connector on the machine.

FIG. 2 is a partially-exploded, plan view of the interconnection between a first CRUM 16 and the machine 10. Forming part of the machine 10 is a terminal 50, which includes a socket 52 disposed therein. Inside the socket 52 is exposed a set of machine-side electrical contacts 54, which are electrically connected to the controller 20. The terminal 50 may also include one or more rigid pins 56 extending within the socket 52, each have a centerline that extends generally parallel with a plane including an exposed surface of the contacts 54. The terminal 50 may further include pin-receiving recesses 58 disposed within the socket 52. FIG. 3 is a plan view of the terminal 50 on the machine 10, which shows the position of the contacts 54, pin 56, and pin-receiving recesses 58 within the socket 52.

Referring again to FIG. 2, attached to a surface of each of the modules 12 and 14 is the CRUM 16, which includes a non-volatile memory 60, such as in the form of an EEPROM (Electrically Erasable Programmable Read Only Memory), which is disposed within a housing 61. The CRUM 16 further includes a set of electrical contacts 62 and pins 64, which are attached to the housing 61. The electrical contacts 62 are exposed on a surface of the CRUM 16 and are electrically connected to the memory 60 by wiring, electrically conductive traces, or the like. Pins 64 extend from the CRUM 16, and each have a centerline that extends generally parallel to a plane including an exposed surface of the recesses 58. The CRUM 16 may further include one'or more pm-receiving recesses 66 disposed therein. The housing 61 may be formed from molded plastic or another dielectric material.

When the module 12 or 14 is installed in the machine 10, a portion of the housing 61 is received within the socket 52 of the terminal 50, and the exposed surfaces of the contacts 62 on the CRUM 16 come into physical contact with the exposed surfaces of the machine-side contacts 54, thus providing electrical connection between the controller 20 and memory 60 and allowing communication of electronic data between the controller 20 and the memory 60. Pin 56 within the socket 52 is received in the recess 66 disposed in the CRUM 16. Similarly, pins 64 extending from the CRUM 16 are received in the recesses 58 formed within the socket. When the module 12 or 14 is installed in the machine 10, the various pins 56 and 64, and recesses 58 and 66 mechanically interlock the CRUM 16 within the socket 52 to ensure proper alignment of the contacts 54 and 62.

The contacts 62, pins 64, and the portion of the housing 61 received by the terminal 50 form part of an interface 68 of the CRUM 16. As used herein, an interface of a CRUM is defined as the electrical, mechanical, and data features of the CRUM at the point of interaction with an external device. For example, the electrical portion of the interface 68 includes the contacts 62, as well as the electrical signals conducted by the contacts 62. The mechanical portion of the interface 68 includes the pins 64 and the portion of the housing 61 received by the terminal 50. The data portion of the interface 68 includes the data indicated by the electrical signals conducted by the contacts.

The interface 68 of the CRUM 16 has an associated format, referred to herein as the interface format. As used herein, an interface format of a CRUM is the arrangement of the electrical, mechanical, and data features of the CRUM at the point of interaction with an external device. For example, the format of the electrical portion of the interface 68 includes the position, dimension, and function of the contacts 62. The format of the electrical portion of the interface 68 also includes the voltage, timing, and function of the electrical signals conducted by the contacts 62. The format of the mechanical portion of the interface 68 includes the position and dimension of the pins 64 and the size and shape of the portion of the housing 61 received by the terminal 50. The format of the data portion of the interface 68 includes the arrangement (protocol) of the data input to, and output from, the CRUM 16. While the interface 68 format is shown as including electrical contacts 62, it will be appreciated that an interface format may include wireless data connections, as will be described in further detail hereinafter.

Typically, multiple CRUMs are manufactured with the same interface format to allow interchangeability and replacement of the CRUMs. For example, if a module 12 or 14 requires replacement, a new module 12 or 14 having a new CRUM with the same interface 68 format may be installed in its place. However, because the terminal 50 of the machine 10 is configured to accept CRUMs having the interface 68 format, the machine 10 may not accept a CRUM having a different interface format (i.e., having different electrical, mechanical, and/or data features at the point of interaction with the machine 10).

Figure 4:
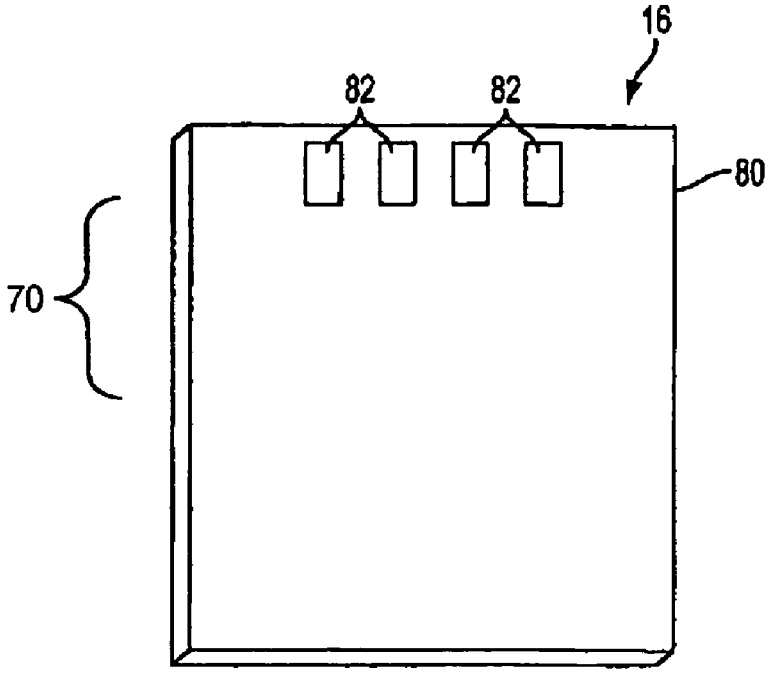
FIG. 4 is a perspective view of a second CRUM having a microprocessor and non-volatile memory disposed in a common package.

FIG. 4 depicts a CRUM 16, with an interface format that is different than the interface format depicted in FIG. 2. The CRUM 16 of FIG. 4 includes an electronic memory (e.g., an EEPRQM) and an integrated circuit (IC) chip (microprocessor) disposed in a common package 80. The package 80 may be formed from molded plastic or another dielectric material, and may be in the form of a so-called smart card or IC card. A smart card (IC card) is a small electronic device that contains an electronic memory and an IC chip disposed in a flat, generally square or rectangular shaped package about the size of a credit card or smaller. One example of a smart card is known as a subscriber identity module (SIM), which is typically used inside of a Global System for Mobile Communications (GSM) cellular telephone.

The interface 70 includes a set of exposed electrical contacts 82 for communicating electronic data. The configuration, position and dimension of the contacts 82, and shape of the package 80 form part of the format of interface 70. The interface 70 format also includes the voltage, timing, and function of the electrical signals conducted by the contacts 82, and the arrangement (protocol) of the data input to, and output from, the contacts 82. The format of interface 70 may be in accordance with one or more industry standards. For example, where the CRUM 16 is a smart card or IC card, the interface format may be in accordance with International Organization for Standardization (ISO) standard 7816.

As can be seen by comparison of FIGS. 2 and 4, the format of interface 70 is different than the format of interface 68. For example, the electrical contacts 62 and 82 are of different size, shape, and position. As another example, the shape of the package 80 is different than the shape of the housing 61.

Figure 5:
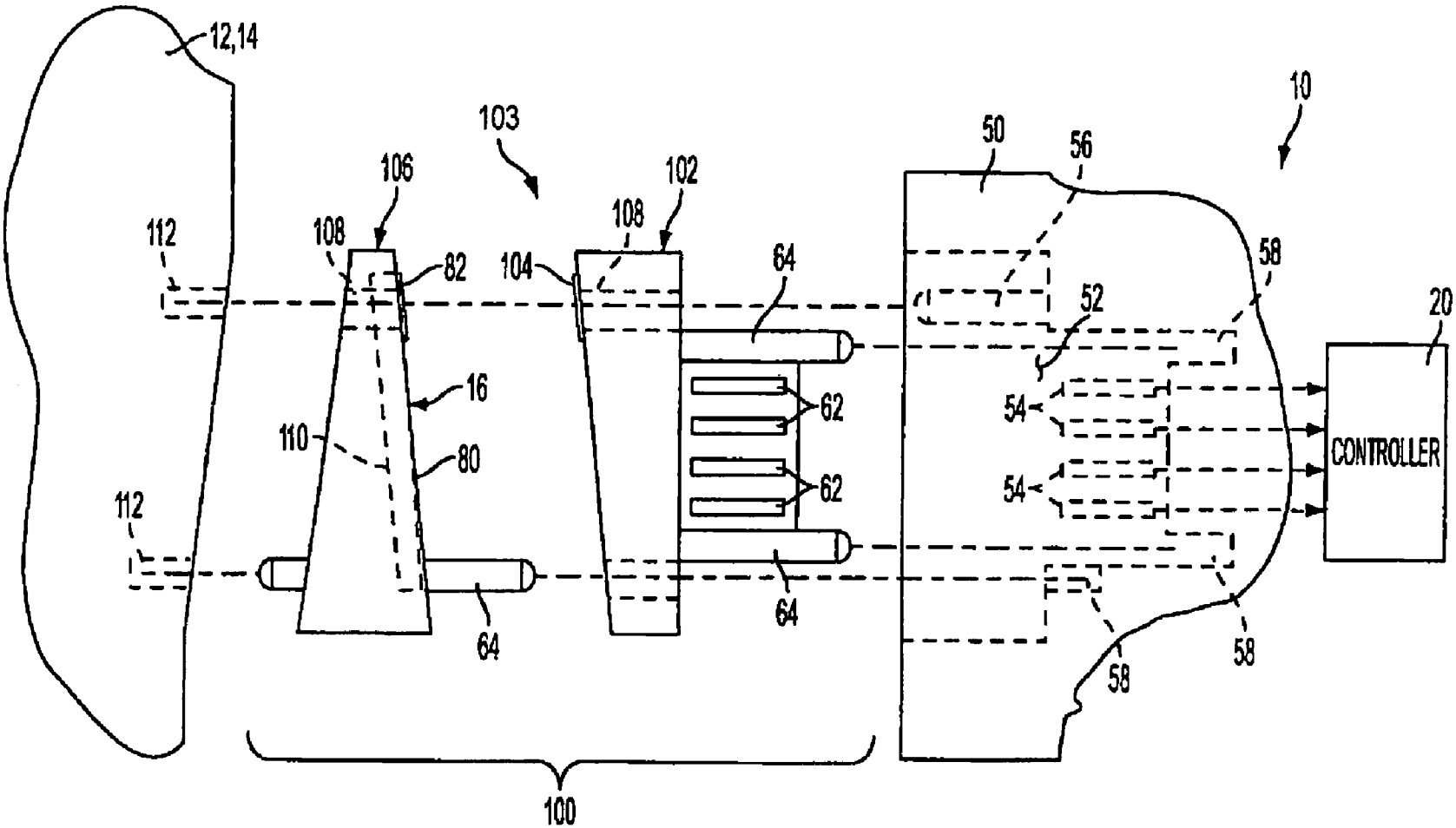
FIG. 5 is a partially-exploded, elevation view of a system for adapting the machine for data communication with the CRUM of FIG. 4.

FIG. 5 is a partially-exploded, elevation view of a system 100 for adapting the machine 10, which is configured for communication with a CRUM having an interface 68 format, for data communication with a CRUM 16 having an interface 70 format. System 100 includes a first adapter 102 installable in the machine 10. The first adapter 102 includes an interface 68 having the same format as the interface 68 of FIG. 2. The adapter 102 also includes an interface 103, which corresponds to the format of the interface 70. The interface 68 is received by the terminal 50, and the interface 70 is received by the interface 103, allowing data communication between the machine 10 and the CRUM 16 via the interfaces 68, 103, and 70.

The system 100 may also include a second adapter 106, which secures the package 80 to the module 12 or 14. The second adapter 106 includes a recess 110 formed therein for receiving the package 80, and the package 80 is retained within the recess 110 by any suitable means, such as, for example, an adhesive, an interference fit between the package 80 and the second adapter 106, or the like. The second adapter 106 may be secured to a surface of the module 12 or 14 using any convenient means, such as, for example, an adhesive, fasteners, and the like. Alternatively, the second adapter 106 may be formed (e.g., molded) as a unitary structure with the module 12 or 14.

The first and second adapters 102, 106 may include mechanical features that correspond to the formats of interfaces 68 and 70. For example, the first and second adapters 102 and 106 include apertures 108 disposed therethrough. Apertures 108 are positioned and dimensioned to receive pins 64, which are attached to the first and second adapters 102, 106, and the pin 56, which is attached to the terminal 50.

When the system 100 is installed in the machine 10, the first set of electrical contacts 62 are in physical contact with the electrical contacts 54 in the machine 10, and the second set of electrical contacts 104 are in physical contact with the electrical contacts 82 on the smart card 80, enabling communication of data between the smart card 80 and the controller 20 of machine 10. Pin 56 within the socket 52 is received in the apertures 108 disposed through the first and second adapters 102, 106. Pin 56 may also be received in a recess 112 formed in the module 12 or 14. Similarly, pins 64 are received in the apertures 108 disposed through the first and second adapters 102, 106, and are received within recesses 58 formed within the socket 52. At least one pin 64 may be received in a recess 112 formed in the module 12 or 14. The various pins 56 and 64, apertures 108 and recesses 58 and 112 secure the first and second adapters 102, 106 between the module 12 or 14 and the machine 10 to ensure proper alignment of the contacts 54, 62, 82, and 104.

It is contemplated that the system 100 may be attached the module 12 or 14 before installing the module 12 or 14 into the machine 10. This attachment may be performed, for example, by a manufacturer of the module 12 or 14. Advantageously, attaching the system 100 to the module 12 or 14 will allow the machine's user or a service person to upgrade the machine 10 to accept a CRUM 16 having a new interface format (e.g., the format of interface 70) by simply installing the module 12 or 14.

Furthermore, it is contemplated that the system 100 may be configured such that, upon removal of the module 12 or 14 from the machine 10, the first adapter 102 remains installed in the terminal 50 while the second adapter 106 remains attached to the module 12 or 14. For example, this may be accomplished by adjusting the frictional interference between the various pins 64, apertures 108, and recesses 112 and 58 such that the force required to separate the first adapter 102 from the machine 10, and the force required to separate the second adapter 106 from the module 12 or 14, are both greater than the force required to separate the first adapter 104 from the second adapter 106. Advantageously, because the first adapter 102 remains installed in machine 10, it will serve as a connection between the machine 10 and all future CRUMs 16 having the same interface format.

Figure 6:
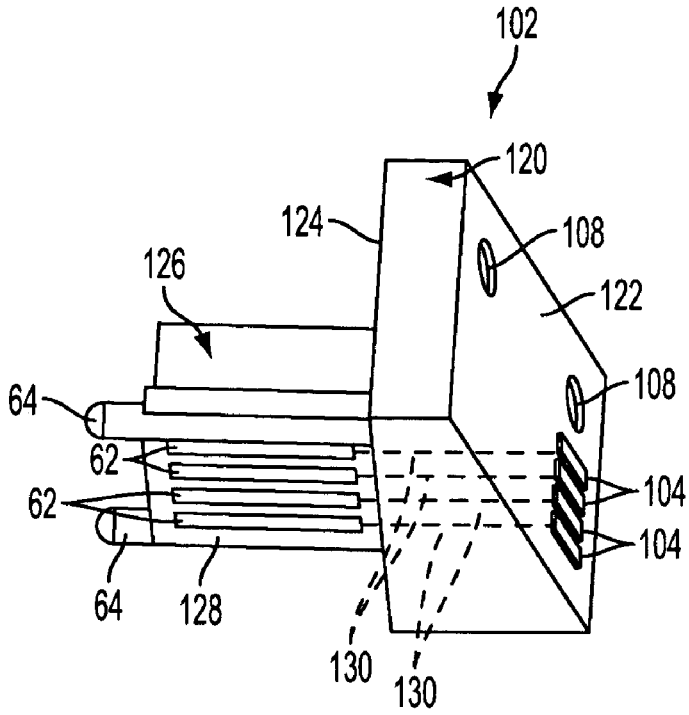
FIG. 6 is a bottom perspective view of a first adapter in the system of FIG. 5.

FIG. 6 is a bottom perspective view of the first adapter 102. In the embodiment shown, the first adapter 102 includes a front portion 120 generally shaped as a six sided prism. Exposed on a front face 122 of the front portion 120 are the contacts 104, which are formed from an electrically conductive material (e.g., copper, aluminum, gold, etc.). Extending through the front portion 120, from the front face 122 to a rear face 124, are the apertures 108. Attached to the rear face 124 is a rear portion 126 of the first adapter 102, which includes a side face 128 that extends generally perpendicular to the rear face 124. Exposed on the side face 128 are the contacts 62, which are formed from an electrically conductive material. Extending along the edges of the side face 128 are the pins 64, the ends of which are secured within the front portion 120.

Each contact 62 is electrically connected to a corresponding contact 104 by a wire 130, electrically conductive trace, or the like, which extends within the front and rear portions 120, 126. While the embodiment of FIG. 6 shows a simple wired connection between corresponding contacts 62 and 104, it is contemplated that the first adapter 102 may include any circuitry necessary to convert between the electrical and data formats of interfaces 68 and 70. For example, the first adapter 102 may include circuitry for amplifying, filtering, or otherwise conditioning the signals between the contacts 62 and 104. In another example, the first adapter 102 may include circuitry for multiplexing, de-multiplexing, converting, digitizing, or otherwise altering and/or arranging the signals between the contacts 62 and 104. It is also contemplated that the first adapter 102 may include a microprocessor for converting data corresponding to the interface 68 format into data corresponding to the interface 70 format, where the formats each apply a different data communications protocol.

Figure 7:
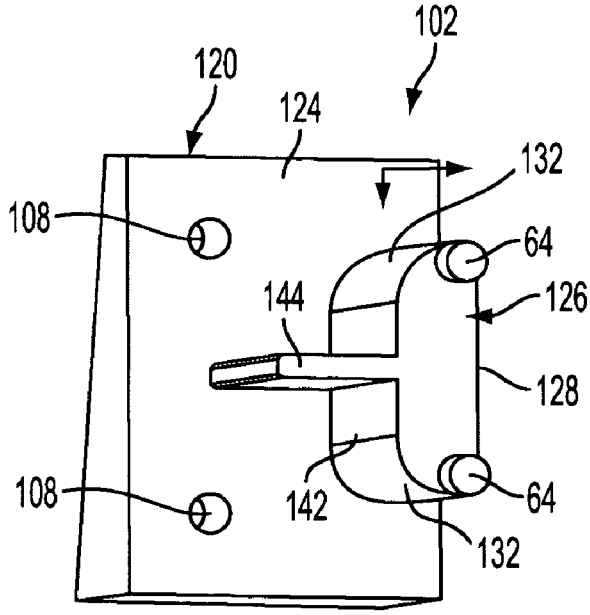
FIG. 7 is a rear perspective view of the first adapter of FIG. 6.

FIG. 7 is a rear perspective view of the first adapter 102. In the embodiment shown, the rear portion 126 is shaped to include radiused edges 132 between the side face and an opposing side face 142. Extending perpendicularly from the side face 142 is a blade 144, which is attached along one edge to the rear face 124 of the front portion 120. Comparing FIG. 7 to FIG. 3, it can be seen that the shape of the rear portion 126, including the radiused edges 132 and blade 144, corresponds to a recess 146 within the socket 52. While the overall physical shape of the first adapter 102 is described herein for example, it is contemplated that the shape of the first adapter 102 may be any shape that allows the first adapter 102 to be received by the terminal 50 of the machine 10. The first adapter 102 may be constructed of any electrically insulative material, such as, for example, plastic, hard rubber, nylon, and the like. The pins, 64 are preferably constructed of a rigid material, such as, for example, steel, aluminum, plastic, or the like.

Figure 8:
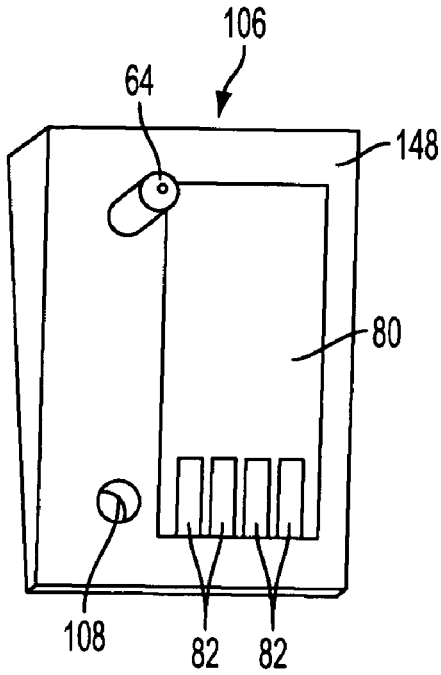
FIG. 8 is a front perspective view of a second adapter in the system of FIG. 5 with the CRUM of FIG. 4 installed therein.
Figure 9:
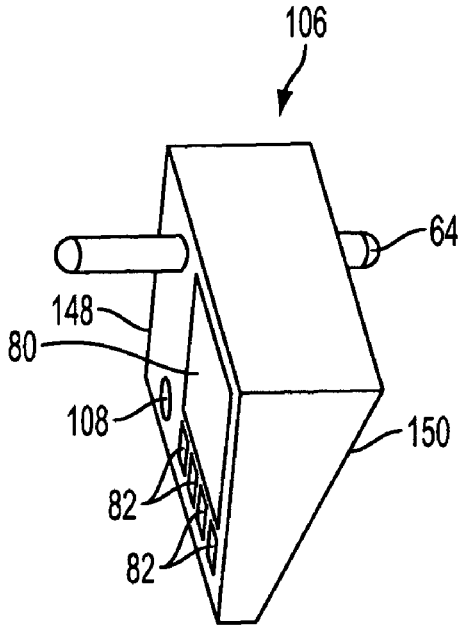
FIG. 9 is a bottom perspective view of the second adapter of FIG. 8.

FIGS. 8 and 9 are front and bottom perspective views, respectively, of the second adapter 106 with the smart card 80 installed therein. In the embodiment shown, the second adapter 106 is generally shaped as a six sided prism, and includes a front face 148, which is generally coplanar with a front face of the smart card 80. Extending through the second adapter 106, from the front face 148 to a rear face 150, is an aperture 108. Also extending through the front face 148 and the rear face 150 is a pin 64, which may be secured within the second adapter 106 by an adhesive, molding, or the like. While the overall physical shape of the second adapter 106 is described herein for example, it is contemplated that the shape of the second adapter 106 may be any shape that allows the second adapter 106 to be secured to the module 12 or 14 (FIG. 5) and that allows the second adapter 106 to abut the first adapter 102 (FIG. 5). The second adapter 106 may be constructed of any electrically insulative material, such as, for example, plastic, hard rubber, nylon, and the like. The pin, 64 is preferably constructed of a rigid material, such as, for example, steel, aluminum, plastic, or the like.

Referring again to FIG. 5, the system 100 allows a machine 10 designed for use with older CRUMs (e.g., the CRUM 16 shown in FIG. 2) to incorporate different CRUM designs without the cost of having to remove and replace the machine-side terminal 50. The system 100 may be provided by a manufacturer as part of the module 12 or 14 such that upgrading the machine 10 to accept the new CRUM 16 simply requires a field technician or the machine's user to install the module 12 or 14 in the machine 10. Furthermore, the system 100 may be configured such that, upon removal of the module 12 or 14 from the machine 10, the first adapter 102 remains installed in the terminal 50 while the second adapter 106 remains attached to the module 12 or 14. Because the first adapter 102 remains installed in machine 10, it will serve as a connection between the machine 10 and all future CRUMs 16 having the new interface format. In addition, system 100 allows the machine 100 to use CRUMs employing a microprocessor and non-volatile memory disposed in a common package (e.g., a smart card or IC card), which are believed to reduce the cost of the CRUM below that possible with CRUMs employing older technologies, while providing an increase in available memory and functionality.

Figure 10:
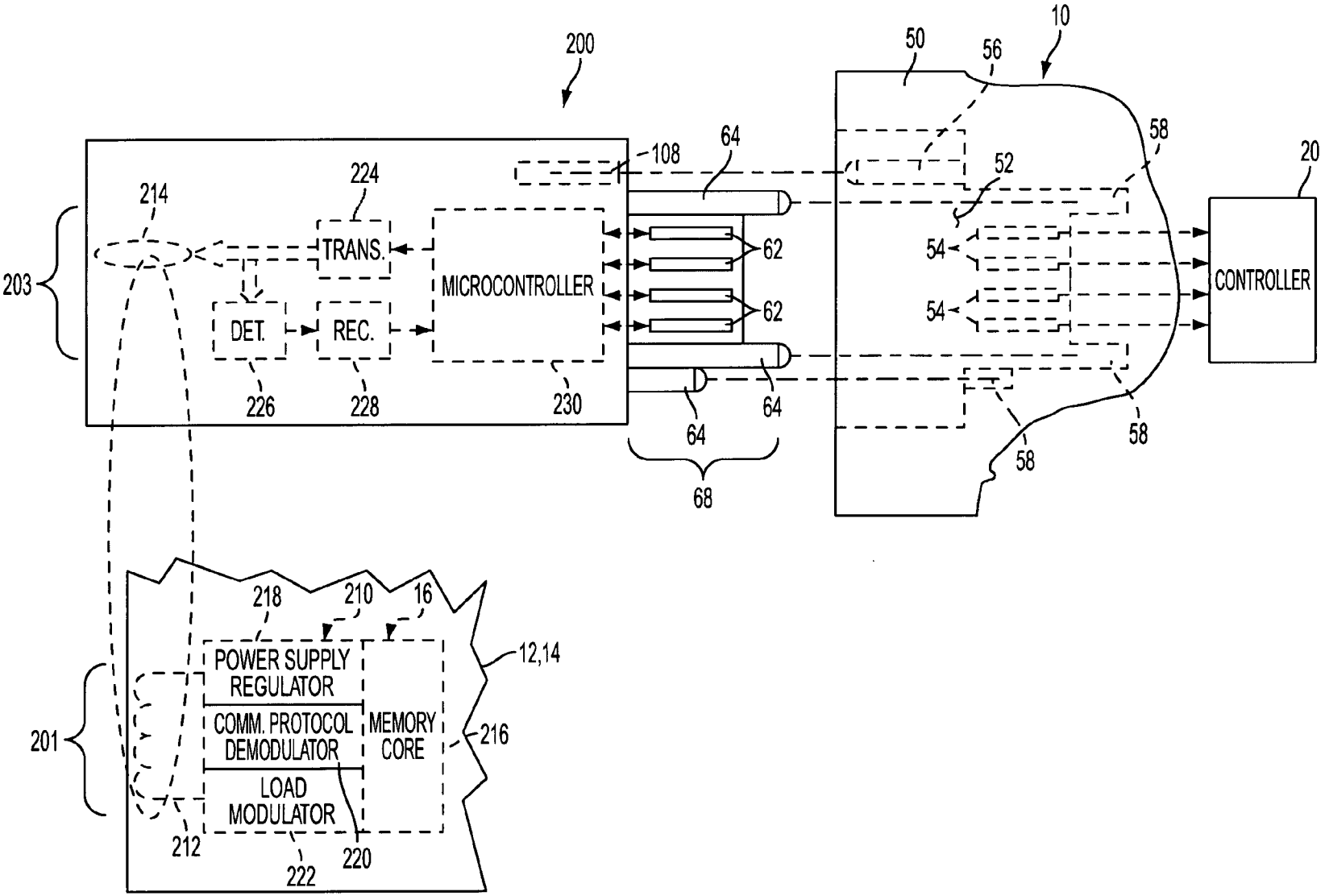
FIG. 10 is a partially-exploded, elevation view of an alternative adapter for adapting the machine for data communication with a CRUM having a wireless interface format.

FIG. 10 is a partially-exploded, elevation view of an adapter 200 for adapting the machine 10, which is configured for communication with a CRUM having an interface 68 format, for data communication with a CRUM 16 having a wireless interface format 201. The adapter 200 includes an interface 68 having the same format as the interface 68 of FIG. 2. The adapter 200 also includes an interface 203, which corresponds to the format of the interface 201 of the CRUM 16. The interface 68 is received by the terminal 50, and the interface 201 communicates wirelessly with the interface 203, thus allowing data communication between the machine 10 and the CRUM 16 via the interfaces 68, 203, and 201.

When the adapter 200 is installed in the machine 10, the first set of electrical contacts 62 are in physical contact with the electrical contacts 54 in the machine 10, enabling communication of data between the adapter 200 and the controller 20 of machine 10. Pin 56 within the socket 52 is received in the aperture 108 disposed in the adapter 200. Similarly, pins 64 are received within recesses 58 formed within the socket 52. The various pins 56 and 64, apertures 108 and recesses 58 secure the adapter 200 to the machine 10 to ensure proper alignment of the contacts 54 and 62.

In the embodiment shown, the CRUM 16 is in the form of a passive radio-frequency identification (RFID) tag 210 that communicates data by way of electric and/or magnetic field coupling between an antenna 212 forming part of the tag 210 and an antenna 214 on the adapter 200. The adapter 200 acts as an RFID reader (also known as an interrogator). The embodiment of *Fig.* 10 is shown for purposes of example, and it will be appreciated that any wireless interface format may be used.

Within the tag 210, data storage and processing as well as radio frequency (RF) communications functions are typically performed by one or more integrated circuit chips. For example, the tag 210 may include: a memory core 216 (e.g., an EEPROM), which stores the data associated with the CRUM 16; a power supply regulator 218, which rectifies and otherwise conditions alternating current induced in the antenna 212 by a time-varying RF signal provided by the antenna 214 on the adapter 200 for use in the tag 210 as a direct current power source; and receiver/emitter modules 220, 222 (e.g., compatible with the ISO 14443 standard) for demodulating and decoding incoming data from the received RF signal and superimposing outgoing data on the RF signal by load variation, respectively.

The adapter 200 includes a transmitter 224 that generates the time-varying RF signal transmitted by the antenna 214. As a result of electromagnetic coupling between the tag antenna 212 and the adapter antenna 214, a portion of the RF signal transmitted by the tag antenna 212 enters the adapter antenna 214 and is separated from the transmitted signal by a detector 226 (e.g., an envelope detector). The separated signal is passed to a receiver 228, where it is amplified, decoded and presented via a microcontroller 230 to the controller 20.

The adapter 200 allows a machine 10 designed for use with older CRUMs (e.g., the CRUM 16 shown in FIG. 2) to incorporate wireless CRUM designs without the cost of having to remove and replace the machine-side terminal 50. Upgrading the machine 10 to accept the wireless CRUM 16 simply requires a field technician or the machine's user to install the adapter 200 in the machine 10. The adapter 200 remains installed in the terminal 50, where it will serve as a connection between the machine 10 and all future CRUMs 16 having a wireless interface format.

It should be understood that any of the features, characteristics, alternatives or modifications described regarding a particular embodiment herein may also be applied, used, or incorporated with any other embodiment described herein.

A number of embodiments of the present invention have been described. Nevertheless, it will be understood that various modifications may be made without departing from the spirit and scope of the invention. Accordingly, other embodiments are within the scope of the following claims.

What is claimed is:

1. An adapter suitable for installation in a machine in place of a first customer replaceable unit monitor having a first interface format, wherein, upon installation of the adapter in the machine, the adapter enables data communication between the machine and a second customer replaceable unit monitor installed in module in the machine and having a second interface format that is different than the first interface format, and facilitates direct mechanical connection between the machine and the module.

2. The adapter of claim 1, wherein the first interface format includes at least one of:

a configuration of an electrical interface of the first customer replaceable unit monitor, a configuration of a mechanical interface of the first customer replaceable unit monitor, and a configuration of data input to, and output from, the first customer replaceable unit monitor; and wherein the second interface format includes at least one of:

a configuration of an electrical interface of the second customer replaceable unit monitor, a configuration of a mechanical interface of the second customer replaceable unit monitor, and a configuration of data input to, and output from, the second customer replaceable unit monitor.

3. The adapter of claim 1, wherein the first interface format includes a configuration of electrical contacts on the first customer replaceable unit monitor, the second interface format includes a configuration of electrical contacts on the second customer replaceable unit monitor that is different than the configuration of electrical contacts on the first customer replaceable unit monitor, and the adapter comprises:

a first set of electrical contacts corresponding to the first interface format; and a second set of electrical contacts corresponding to the second interface format, wherein the first set of electrical contacts are in physical contact with a set of electrical contacts in the machine, and the second set of electrical contacts are in physical contact with the electrical contacts on the second customer replaceable unit monitor when the adapter is installed in the machine.

4. The adapter of claim 1, wherein the first interface format includes electrical contacts for the communication of data and the second interface format employs wireless data communication.

5. The adapter of claim 1, wherein the adapter converts electronic signals corresponding to the first interface format into electronic signals corresponding to the second interface format.

6. The adapter of claim 1, wherein the adapter converts data corresponding to the first interface format into data corresponding to the second interface format.

7. The adapter of claim 1, wherein the second customer replaceable unit monitor includes a microprocessor and non-volatile memory disposed in a common package.

8. The adapter of claim 1, wherein the adapter is attached to the module before the module is installed in the machine.

9. The adapter of claim 8, wherein the adapter remains attached to the machine when the module is removed from the machine.

10. A method for adapting a machine to communicate with different customer replaceable unit monitors, the method comprising:

installing an adapter in a machine in place of a first customer replaceable unit monitor having a first interface format; and installing a replaceable module into the machine, the replaceable module including a second customer replaceable unit monitor having a second interface format that is different than the first interface format, wherein the adapter enables data communication between the machine and the second customer replaceable unit monitor,and facilitates direct mechanical connection between the machine and the replaceable module.

11. The method of claim 10, wherein the first interface format includes at least one of:

a configuration of an electrical interface of the first customer replaceable unit monitor, a configuration of a mechanical interface of the first customer replaceable unit monitor,and a configuration of data input to and output from the first customer replaceable unit monitor; and wherein the second interface format includes at least one of:

a configuration of an electrical interface of the second customer replaceable unit monitor, a configuration of a mechanical interface of the second customer replaceable unit monitor, and a configuration of data input to, and output from, the second customer replaceable unit monitor.

12. The method of claim 10, wherein the first interface format includes a configuration of electrical contacts on the first customer replaceable unit monitor, the second interface format includes a configuration of electrical contacts on the second customer replaceable unit monitor that is different than the configuration of electrical contacts on the first customer replaceable unit monitor, and the adapter comprises:

a first set of electrical contacts corresponding to the first interface format; and a second set of electrical contacts corresponding to the second interface format, wherein the first set of electrical contacts are in physical contact with a set of electrical contacts in the machine, and the second set of electrical contacts are in physical contact with the electrical contacts on the second customer replaceable unit monitor when the adapter is installed in the machine.

13. The method of claim 10, wherein the first interface format includes electrical contacts for the communication of data and the second interface format employs wireless data communication.

14. The method of claim 10, wherein the adapter converts electronic signals corresponding to the first interface format into electronic signals corresponding to the second interface format.

15. The method of claim 10, wherein the adapter converts data corresponding to the first interface format into data corresponding to the second interface format.

16. The method of claim 10, wherein the second customer replaceable unit monitor includes a microprocessor and non-volatile memory disposed in a common package.

17. The method of claim 10, further comprising:

attaching the adapter to the replaceable module before installing the replaceable module into the machine; and wherein installing the replaceable module into the machine also installs the adapter into the machine.

18. The method of claim 10, further comprising:

removing the replaceable module from the machine while leaving the adapter attached to the machine.

19. A machine comprising:

a terminal attached to the machine, the terminal being configured to receive a first customer replaceable unit monitor having a first interface format;

a replaceable module installed in the machine;

a second customer replaceable unit monitor attached to the replaceable module, the second customer replaceable unit monitor having a second interface format that is different than the first interface format; and an adapter coupled to the terminal in place of the first customer replaceable unit monitor, wherein the adapter enables data communication between the machine and the second customer replaceable unit monitor,and facilitates direct mechanical connection between the machine and the replaceable module.

20. The machine of claim 19, wherein the first interface format includes at least one of:

a configuration of an electrical interface of the first customer replaceable unit monitor, a configuration of a mechanical interface of the first customer replaceable unit monitor, and a configuration of data input to and output from the first customer replaceable unit monitor; and wherein the second interface format includes at least one of:

a configuration of an electrical interface of the second customer replaceable unit monitor, a configuration of a mechanical interface of the second customer replaceable unit monitor, and a configuration of data input to and output from the second customer replaceable unit monitor.

21. The machine of claim 19, wherein the first interface format includes a configuration of electrical contacts on the first customer replaceable unit monitor, the second interface format includes a configuration of electrical contacts on the second customer replaceable unit monitor that is different than the configuration of electrical contacts on the first customer replaceable unit monitor, and the adapter comprises:

a first set of electrical contacts corresponding to the first interface format; and a second set of electrical contacts corresponding to the second interface format, wherein the first set of electrical contacts are in physical contact with a set of electrical contacts in the terminal, and the second set of electrical contacts are in physical contact with the electrical contacts on the second customer replaceable unit monitor.

22. The machine of claim 19, wherein the first interface format includes electrical contacts for the communication of data and the second interface format employs wireless data communication.

23. The machine of claim 19, wherein the adapter converts electronic signals corresponding to the first interface format into electronic signals corresponding to the second interface format.

24. The machine of claim 19, wherein the adapter converts data corresponding to the first interface format into data corresponding to the second interface format.

25. The machine of claim 19, wherein the second customer replaceable unit monitor includes a microprocessor and non-volatile memory disposed in a common package.

26. The machine of claim 19, wherein the adapter is attached to the replaceable module before the replaceable module is installed in the machine.

27. The machine of claim 26, wherein the adapter remains attached to the machine when the replaceable module is removed from the machine.

28. The machine of claim 19, wherein the replaceable module includes hardware for printing.

29. The machine of claim 28, wherein the replaceable module includes hardware for electrostatographic printing.

30. An adapter suitable for installation in a machine in place of a first customer replaceable unit monitor having a first interface format, wherein upon installation of the adapter in the machine, the adapter enables data communication between the machine and a second customer replaceable unit monitor having a second interface format that is different than the first interface format, the adapter has a front face and an opposing rear face, the front face having exposed thereon electrical contacts in accordance with the second interface format and the rear face having a rear portion attached thereto for making mechanical connection to the machine and electrical connection to the machine in accordance with the first interface format, and the adapter has an aperture extending from the front face to the rear face, for facilitating mechanical connection to the machine of a module including the second customer replaceable unit monitor.

31. A system comprising:

a first adapter suitable for installation in a machine in place of a first customer replaceable unit monitor having a first interface format, wherein, upon installation of the first adapter in the machine, the first adapter enables data communication between the machine and a second customer replaceable unit monitor having a second interface format that is different than the first interface format; and a second adapter including the second customer replaceable unit monitor, wherein, upon installation of the second adapter in the machine, the second adapter makes direct mechanical connection with the first adapter and with the machine.

* * * * *

UNITED STATES PATENT AND TRADEMARK OFFICE

CERTIFICATE OF CORRECTION

PATENT NO. : 7,529,491 B2
APPLICATION NO. : 11/227042
DATED : May 5, 2009
INVENTOR(S) : Heiko Rommelmann et al.

It is certified that error appears in the above-identified patent and that said Letters Patent is hereby corrected as shown below:

On the Title Page, Item (74) should read
Attorney, Agent, or Firm - Wiggin and Dana LLP Signed and Sealed this Twenty-third Day of June, 2009

JOHN DOLL
*Acting Director of the United States Patent and Trademark Office*